US007419444B2

(12) United States Patent
Kunsman

(10) Patent No.: US 7,419,444 B2
(45) Date of Patent: Sep. 2, 2008

(54) TENNIS TRAINING APPARATUS AND METHOD OF USE THEREOF

(76) Inventor: Martin Kunsman, 508 River Pl., Woodstock, GA (US) 30188

( * ) Notice: Subject to any disclaimer, the term of this patent is extended or adjusted under 35 U.S.C. 154(b) by 220 days.

(21) Appl. No.: 11/243,832

(22) Filed: Oct. 5, 2005

(65) Prior Publication Data

US 2006/0073920 A1 Apr. 6, 2006

Related U.S. Application Data

(60) Provisional application No. 60/615,902, filed on Oct. 5, 2004.

(51) Int. Cl.
*A63B 69/38* (2006.01)

(52) U.S. Cl. ..... 473/464

(58) Field of Classification Search ..... 473/459, 473/461, 463, 464, 450, 458, 207, 215
See application file for complete search history.

(56) References Cited

U.S. PATENT DOCUMENTS

| | | | | | |
|---|---|---|---|---|---|
| 3,000,633 | A | * | 9/1961 | Bonovich | 473/63 |
| 3,693,973 | A | | 9/1972 | Wattenburg | |
| 3,858,881 | A | | 1/1975 | Hurwitz | |
| 3,918,721 | A | | 11/1975 | Trask, Jr. | |
| 3,937,465 | A | | 2/1976 | Roland | |
| 4,030,732 | A | * | 6/1977 | Vincent | 473/464 |
| 4,150,821 | A | | 4/1979 | Racz | |
| 4,209,169 | A | | 6/1980 | Roberts | |
| 4,265,448 | A | | 5/1981 | Anderson, Jr. | |
| 4,322,077 | A | | 3/1982 | Van't Hof | |
| 4,445,686 | A | * | 5/1984 | Daugherty | 473/464 |
| 4,591,156 | A | | 5/1986 | Attenni | |
| 4,720,106 | A | * | 1/1988 | Bickham | 473/521 |
| 5,060,942 | A | * | 10/1991 | Dalbo | 473/215 |
| 5,257,779 | A | * | 11/1993 | Dalbo | 473/215 |
| 5,435,563 | A | * | 7/1995 | Salvatore | 473/215 |
| 5,456,037 | A | | 10/1995 | Dorval | |
| 5,472,190 | A | | 12/1995 | Norling | |
| 5,476,257 | A | | 12/1995 | Bobby | |
| 5,618,040 | A | * | 4/1997 | Parten | 473/461 |
| 5,797,814 | A | | 8/1998 | Janes et al. | |
| 6,299,557 | B1 | | 10/2001 | Mueller | |
| 2003/0069094 | A1 | * | 4/2003 | Sheppard | 473/461 |
| 2006/0073920 | A1 | * | 4/2006 | Kunsman | 473/450 |

* cited by examiner

*Primary Examiner*—Raleigh W. Chiu
(74) *Attorney, Agent, or Firm*—Williamson Intellectual Property Law, LLC; Thomas R. Williamson, III

(57) ABSTRACT

A tennis training apparatus and method of use thereof, for improving a forehand and/or backhand of a tennis player. The apparatus includes a wristband, an "L"-shaped bracket attached to the racket, and an inflexible strap linking the L-shaped bracket to the wristband. When the strap is tightened, it causes the wrist to bend backwards in extension at an approximately ninety degree angle to the forearm. A second component of the training aid is a restraining plate in the form of a torso attachment worn by the player, wherein the torso attachment retains alignment of the player's hand, hips and shoulders; thereby, forcing the player to rotate his hips to perform a stroke. The torso attachment may be subsequently employed or removed during two-handed backhand strokes. The tennis training apparatus significantly improves the power and control of strokes, and also reduces and/or prevents the risk of developing tennis elbow.

15 Claims, 3 Drawing Sheets

TENNIS TRAINING APPARATUS AND METHOD OF USE THEREOF

PRIORITY CLAIM

To the fullest extent permitted by law, the present non-provisional patent application claims priority to, and the full benefit of provisional patent application entitled "Tennis Training Apparatus and Method of Use Thereof", filed on Oct. 5, 2004, having assigned Ser. No. 60/615,902.

TECHNICAL FIELD

The present invention relates generally to sports training devices, and more specifically to a tennis training apparatus and method of use thereof, wherein attachments to a tennis racket and to a player facilitate utilization of the correct position and technique in the play of tennis, thereby improving the forehand and/or backhand strokes of the player.

BACKGROUND OF THE INVENTION

It is widely recognized that proper handling of a tennis racket requires a steady wrist to control the racket face and allow for a more precise hit, thereby resulting in more consistency of stroke and less vibration of the racket. Indeed, maintaining a steady wrist may reduce the likelihood of developing tennis elbow.

Accordingly, many training devices have been developed to assist in preventing a player's wrist from bending during certain tennis strokes. Notably, training device designs which limit wrist movement also keep the player from snapping his hand at the ball, an action that may create significant inconsistency at the point where the racket face hits the ball. In other words, keeping the wrist still, keeps the racket face relatively still, which consequently reduces and/or eliminates mis-hits and mis-timing problems.

Many available tennis training devices, in particular those for the prevention of tennis elbow, function by maintaining the user's arm and hand in a selected position. However, most such devices attempt to fix the hand position alone, rather than constraining the hand in relation to the forearm or restraining flexural movement of the hand, and further do not maintain hand position in the fully backward-extended state. Additionally, most available devices do not provide for positioning of the body relative to the hand in which the tennis racket is held, as such devices do not maintain the player's hand, hips and shoulders in an aligned configuration.

For instance, U.S. Pat. No. 5,476,257 to Bobby teaches a rigid restraint that attaches to the top of the tennis racket. The device of Bobby '257 permits attachment of the rigid restraint to the arm above or below the elbow; however, it does not provide a means for keeping the player's hand, hips and shoulders aligned, wherein such alignment requires the desired hip rotation to accomplish a full and proper tennis swing.

U.S. Pat. No. 4,209,169 to Roberts discloses a wrist-to-racket angulation aid for tennis players, comprising a wrist-band, a racket-handle band, and interconnectable strap segments separately attached to such bands, for tethering the racket handle to the player's wrist. This forces the player to hold the head of the racket above the wrist; thereby, forcing the handle of the racket to assume a selected angle with respect to the player's forearm. However, the Roberts '169 device maintains a hand position approximately midway between fully flexed and fully extended, wherein extension is backward positioning of the hand and flexion is forward positioning of the hand. However, the desired position for a proper tennis stroke is to have the hand in a fully extended orientation. Furthermore, Roberts '169 does not provide a means for maintaining alignment of the player's hand, hips and shoulders, so as to promote the desired hip rotation for accomplishing a full and proper tennis swing.

U.S. Pat. No. 5,618,040 to Parten discloses a tennis aid for improving the stroke of a tennis player, comprising a wrist-band and an associated elastic cord attached thereto. The cord is attached to the wristband near its midpoint, wherein the opposite ends of the cord may be attached to the head of a tennis racket. When the handle of the racket is properly held by the tennis player, tension in the cord will tend to prevent the player from bending the wrist in flexion or extension during a tennis stroke. However, the device of Parten '040 requires connection at two points of the racket, instead of a less-complicated single point, and further does not restrain the position of the hand at a ninety-degree angle relative to the forearm. Furthermore, the device of Parten '040 does not provide a means for maintaining the player's hand, hips and shoulders in an aligned position, wherein such alignment requires the desired hip rotation to accomplish a full and proper tennis swing.

U.S. Pat. No. 4,720,106 to Bickham teaches a vibration dampening device comprising a rigid support member that projects outwardly from the back of the racket. However, such a rigid support may interfere with backhand tennis strokes. Furthermore, the device of Bickham '106 does not restrain the hand in a backward position, nor does Bickham '106 provide a means for maintaining the player's hand, hips and shoulders in an aligned position, wherein such alignment requires the desired hip rotation to accomplish a full tennis swing.

U.S. Pat. No. 4,445,686 to Daugherty discloses a rigid device that is attached to both a tennis racket and a player's forearm, wherein the device restrains the hand position relative to the forearm throughout a tennis stroke. However, the device of Daugherty '686 maintains the hand midway between flexion and extension and further comprises a rigid member that appears to transfer the shock and stress of a tennis stroke from the racket to the hand and forearm; thereby, causing the player to tire quickly. Furthermore, the device of Daugherty '686 does not facilitate maintenance of the player's hand, hips and shoulders aligned together to best provide the desired hip rotation for a full and proper tennis stroke.

U.S. Pat. No. 3,858,881 to Hurwitz teaches a device for maintaining a selected angle between the racket and the forearm in order to prevent 'tennis elbow'. The device secures to a band around the forearm and is secured around the midpoint of the handle of the racket. Unfortunately, however, the device is elastic and, as such, does not provide a rigid restraint fixing the angle between the racket and the forearm. Further, the position of the forearm band at the midpoint of the forearm may disadvantageously allow the band to move along the arm under the stresses and flexures of tennis play; thereby, reducing the device's effectiveness. Furthermore, the device of Hurwitz '881 does not provide a means for keeping the player's, hand, hips and shoulders aligned, wherein such alignment requires the desired hip rotation to accomplish a full tennis swing.

None of the above-referenced training devices restrain the player's wrist to form an angle of approximately ninety degrees between the hand and the forearm. Moreover, none utilize an L-shaped bracket for attachment to the tennis racket to provide support, and none include a means for maintaining the player's, hand, hips and shoulders in an aligned configuration or position.

Therefore, it is readily apparent that there is a need for a tennis training apparatus and method of use thereof, for forcing or constraining a player to hold the racket in the correct position throughout his/her swing, and for reducing exercise-induced muscle strain and/or injury. There is a further need for such a device that maintains the player's hand, hips and shoulders in an aligned position.

BRIEF SUMMARY OF THE INVENTION

Briefly described, in a preferred embodiment, the present invention overcomes the above-mentioned disadvantages and meets the recognized need for such a device by providing a tennis training apparatus and method of use thereof, wherein the apparatus constrains the player's hand in a backward position, and wherein the apparatus further maintains the player's hand, hips and shoulders in an aligned configuration or position.

The present invention centers around an advanced evolution in the way tennis balls are now being struck by top level players. The wrist is actually bent backwards creating a ninety-degree angle between hand and forearm.

The present invention provides a tennis aid that is designed to teach a tennis player to keep his racket face facing the same direction as his shoulders (i.e., same plane). Players are required to utilize hip/shoulder/torso rotation to generate racket head speed. The stroke comes from the large muscle groups rather than just the arm. It is this style that is utilized by professional tennis players, college players, and even most skilled high school players. Because such experienced players utilize correct body mechanics, they are less likely to suffer from tennis elbow, which results from improper body mechanics. Accordingly, the present invention facilitates in achieving advanced fundamentals that will allow the amateur player to safely improve to a high level of play, and thereby prevent injury.

According to its major aspects and broadly stated, the present invention in its preferred form is an "L"-shaped bracket that attaches to a tennis racket, wherein the bracket is connected to a wrist mount via a constraining strap, such that a player holding the tennis racket in his/her hand must keep his/her hand in a backward and fully-extended position. Additionally, the apparatus of the present invention includes a plate device that fastens to the body of the tennis player. The plate blocks the player's arm from crossing the body, wherein the plate requires the desired rotation of the player's hips, while forcing the player to keep his hand, hips and shoulders aligned. The "L"-shaped bracket, constraining strap and wrist mount can alternately be attached to the non-dominant hand and wrist of the player to facilitate training in backhand strokes.

More specifically, the present invention is a tennis training apparatus and method of use thereof, wherein the apparatus comprises a wrist band, an "L"-bracket that attaches to the neck of the racket, and an inflexible constraining strap that links the "L"-bracket to the wrist band. When the inflexible strap is tightened it causes the player's wrist to bend backwards (extension) at an approximately ninety degree angle to the forearm. A second component of the training apparatus is a rectangular, preferably square, plate that is strapped to the side of the torso of a player, wherein the plate extends forward forming an approximately ninety degree angle with the player's torso. When utilized together, the wrist attachment and the torso attachment force the player to utilize body rotation (torque) to create racket head acceleration. The above racket restraint and torso plate attachment facilitate the training of forehand tennis strokes. For two-handed backhand strokes, the torso plate can be selectively employed or removed.

Accordingly, a feature and advantage of the present invention is its ability to constrain a tennis player's hand extended at an angle of approximately ninety degrees from his/her forearm.

Another feature and advantage of the present invention is its ability to restrain flexural movement of a tennis player's hand during a tennis stroke.

Still another feature and advantage of the present invention is its ability to be utilized for both forehand and backhand tennis stroke training.

Yet another feature and advantage of the present invention is its ability to constrain a player's hips, shoulders and hand in an aligned position.

Yet still another feature and advantage of the present invention is that it forces a player to rotate his hips making a tennis stroke.

A further feature and advantage of the present invention is its ability to reduce and/or eliminate the risk of developing tennis elbow.

Still a further feature and advantage of the present invention is that it forces a tennis player to utilize proper technical tennis mechanics.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

Figure 1:
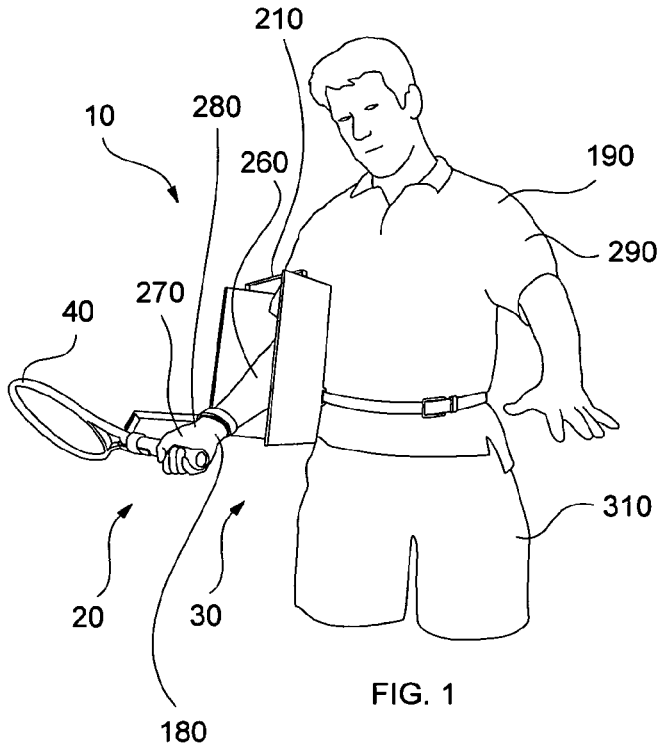
FIG. 1 is a perspective view of a tennis player equipped with a tennis training apparatus according to a preferred embodiment of the present invention, shown at the beginning of a tennis stroke.

In describing the preferred and selected alternate embodiments of the present invention, as illustrated in FIGS. 1-6, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1-5, the present invention in a preferred embodiment comprises tennis training apparatus 10 and associated method of use thereof, wherein tennis training apparatus 10 preferably comprises racket angulation restraining component 20 and plate restraining component 30. Racket angulation component 30 preferably comprises bracket 70, restraining strap 110 and wrist band 160, wherein restraining strap 110 preferably forms angle 170 when secured to bracket 70 and wrist band 160. In concert with racket angulation restraining component 20, plate restraining component 30, described hereinbelow, preferably completes the two-component tennis training apparatus 10.

Bracket 70 preferably comprises first leg 80 and second leg 90, wherein first leg 80 is preferably disposed and secured on front face 140 of racket 40, proximate to shaft 55 of racket 40 above handle 50, and wherein second leg 90 preferably extends through gap 60. Once secured in place, second leg 90 preferably extends away from back face 130 of racket 40. First leg 80 is preferably removably secured via securing mechanism 100, but could also be fixably secured to shaft 55 of racket 40. Thus, securing mechanism 100 could comprise a fastener, an elastic device, hook-and-loop device, glue, or the like.

Restraining strap 110 preferably comprises first end 150 and second end 155, wherein first end 150 is preferably removably secured to second leg 90 via any suitable attaching article 105, such as, for exemplary purposes only, a hook-and-loop fastener. It will be recognized by those skilled within the art that other commonly available fasteners could be utilized.

Restraining strap 110 preferably forms angle 170 as it extends over tip 75 of second leg 90 of bracket 70. Second end 155 of restraining strap 110 is preferably fixably attached to wrist band 160, wherein wrist band 160 is preferably removably secured to wrist 180 of tennis player 190. It will be recognized by those in the art that restraining strap 110 and wristband 160 could be separate, or could be integrally formed as a single piece.

Plate restraining component 30 preferably comprises plate 200, top strap 210 and bottom strap 220, wherein plate 200 preferably comprises first section 230, second section 240 and third section 250. Second section 240 is preferably disposed between first section 230 and third section 250, wherein first section 230 is preferably disposed at an angle of between approximately ninety to approximately one hundred and twenty degrees from second section 240, and wherein third section 250 is preferably disposed at an angle of between approximately ninety to approximately one hundred and twenty degrees from second section 240.

Bottom strap 220 is preferably carried by second section 240, wherein bottom strap 220 is suitable for removably securing plate 200 to tennis player 190, and wherein bottom strap 220 preferably comprises belt-and-buckle 225 or other suitable device for fastening plate 200 around tennis player 220. First section 230 and third section 250 preferably comprise first top 232 and third top 252, respectively, wherein top strap 210 is preferably releasably secured via securing posts 212 to first top 232 and third top 252.

In performing a tennis stroke, racket angulation restraining component 20 is preferably secured to wrist 180 of tennis player 190, wherein wrist band 160 is preferably secured to wrist 180 of tennis player 190. Plate 200 is preferably removably secured to torso 195 of tennis player 190 via bottom strap 220, wherein tennis player 190 preferably passes stroking arm 260 between second section 240 and top strap 210. Second end 155 of securing strap 110 is preferably secured to wristband 160, and first end 150 is preferably secured to second leg 90 of bracket 70. Tennis player 190 then preferably grips racket 40, to which bracket 70 and restraining strap 100 have been preferably previously secured, and performs a tennis stroke as set forth hereinbelow.

Figure 2:
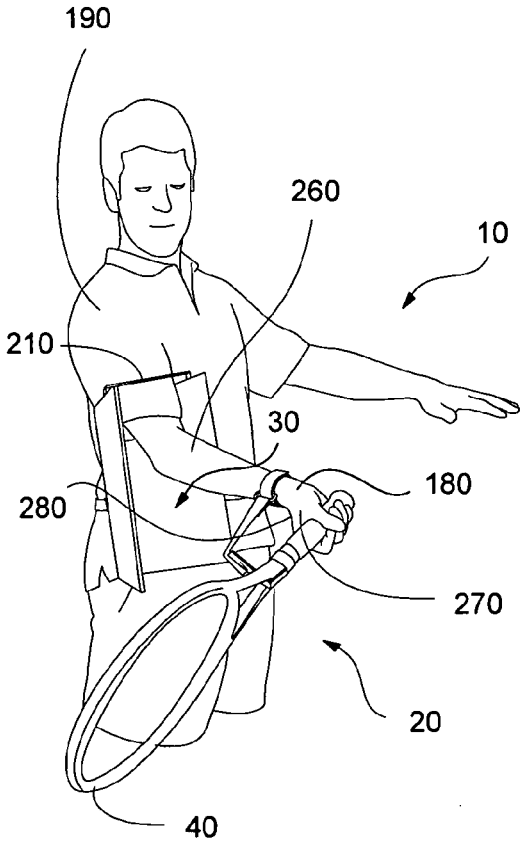
FIG. 2 is a perspective view of a tennis player equipped with a tennis training apparatus according to a preferred embodiment of the present invention, shown during the course of a tennis stroke.
Figure 3:
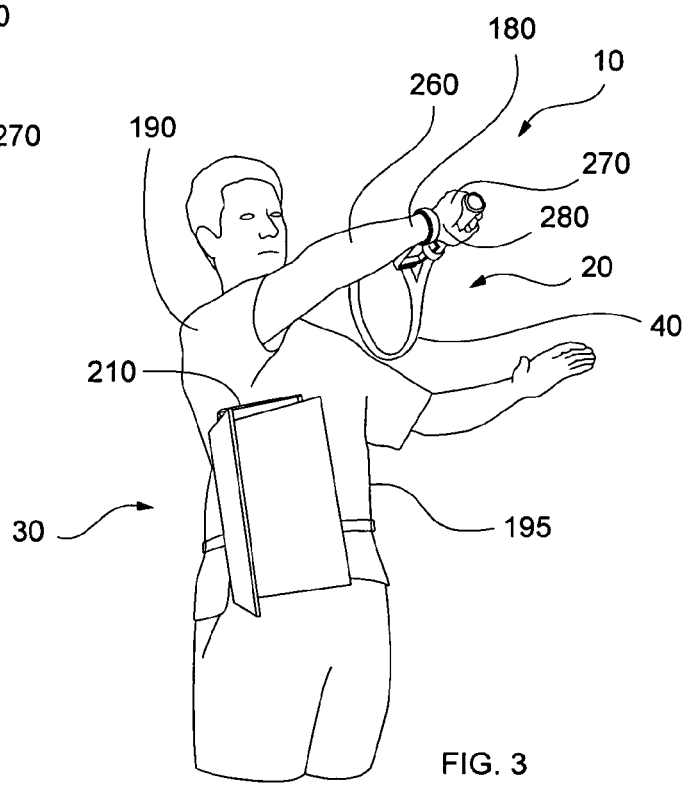
FIG. 3 is a perspective view of a tennis player equipped with a tennis training apparatus according to a preferred embodiment of the present invention, shown at the completion of a tennis stroke.
Figure 4:
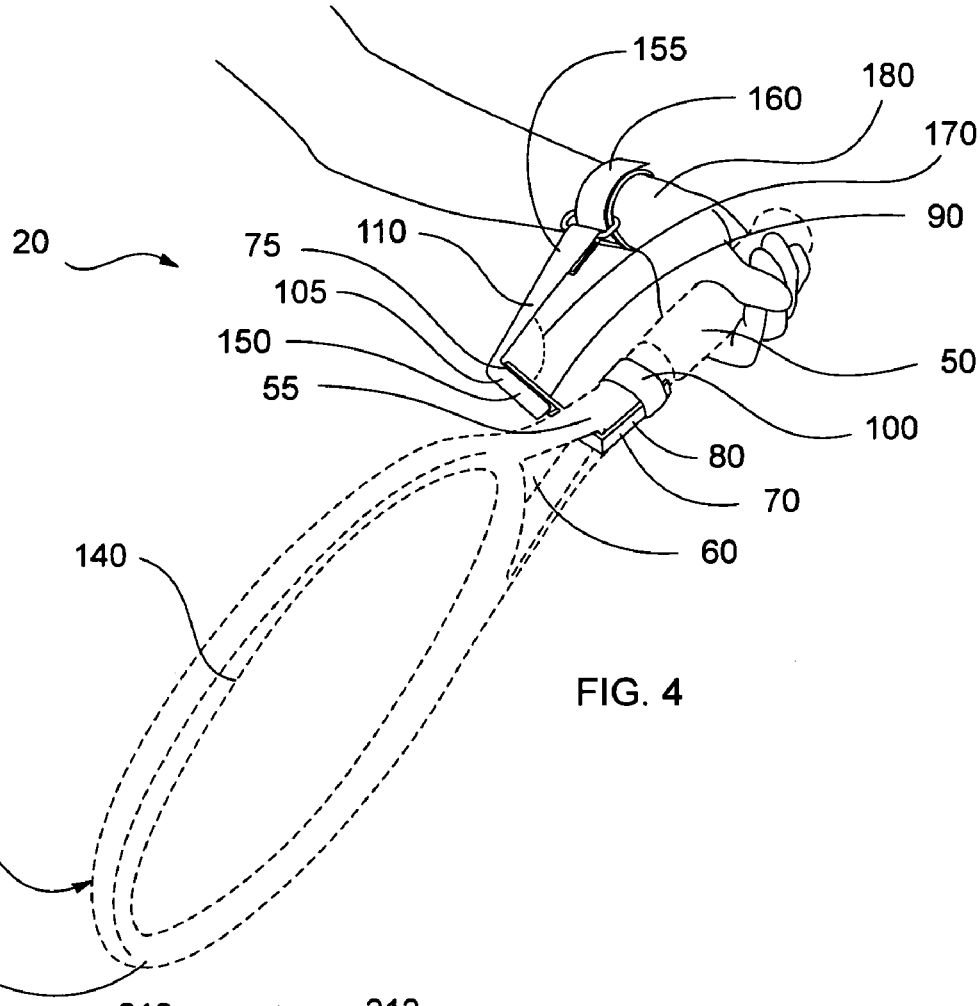
FIG. 4 is a perspective view of a racket angulation restraining component of a tennis training apparatus according to a preferred embodiment of the present invention.
Figure 5:
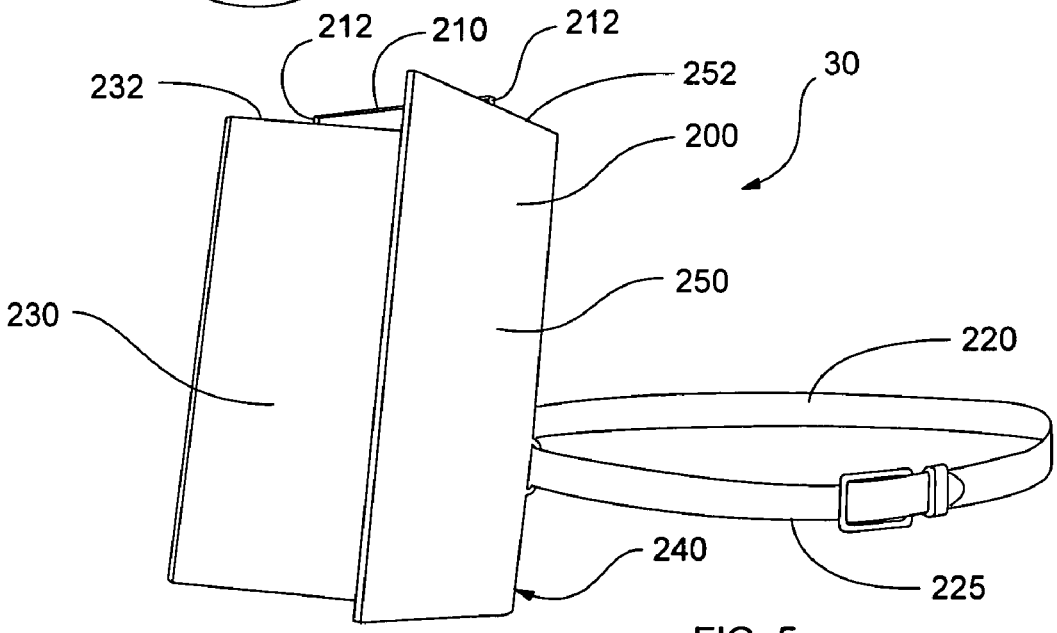
FIG. 5 is a perspective view of a plate restraining component of a tennis training apparatus according to a preferred embodiment of the present invention; and, FIG. 6 is a perspective view of a tennis player equipped with a racket angulation restraining component of a tennis training apparatus according to an alternate embodiment of the present invention, shown at the beginning of a two-handed backhand tennis stroke.

In the performance of a typical tennis stroke, there are typically three stages, as best sequentially depicted by FIGS. 1-3, respectively. At all times during the performance of the stroke sequence depicted in FIGS. 1-3, wrist angle 280 preferably remains constant, wherein hand 270 is preferably constrained backward in extension at approximately ninety degrees from stroking arm 260 via racket angulation restraining component 20.

Referring to FIG. 1, preparatory to making a stroke, tennis player 190 preferably has stroking arm 260 within plate restraining component 30, wherein racket 40 is preferably positioned at a backward angle. The position of stroking arm 260 within plate restraining component 30 forces shoulders 290 and hips 310 of tennis player 190 to move together substantially parallel as the stroke is made. Referring to FIG. 2, tennis player 190 is shown in the course of making a tennis stroke, wherein stroking arm 260 preferably remains within plate restraining component 30, keeping shoulders 290 and hips 310 together substantially parallel. Referring to FIG. 3, stroking arm 260 has now moved upward and is released from plate restraining component 30, as tennis player 190 completes the stroke.

It is contemplated in an alternate embodiment that plate restraining component 30 could be eliminated, thereby relying upon racket angulation restraining component 20, and the hand-to-forearm angle constrained thereby, to maintain a desired tennis stroke.

It is contemplated in another alternate embodiment of the present invention that first section 230, second section 240 and third section 250 could be hingably secured together for convenient folding and/or adjustment.

It is contemplated in yet another alternate embodiment of the present invention that second section 240 could be eliminated to provide more restraint, wherein first section 230 could be hingably secured directly to third section. 250, and wherein first section 230 and second section 250 could be disposed at a selected angle of between approximately sixty degrees and approximately one-hundred-and-twenty degrees to one another.

Figure 6:
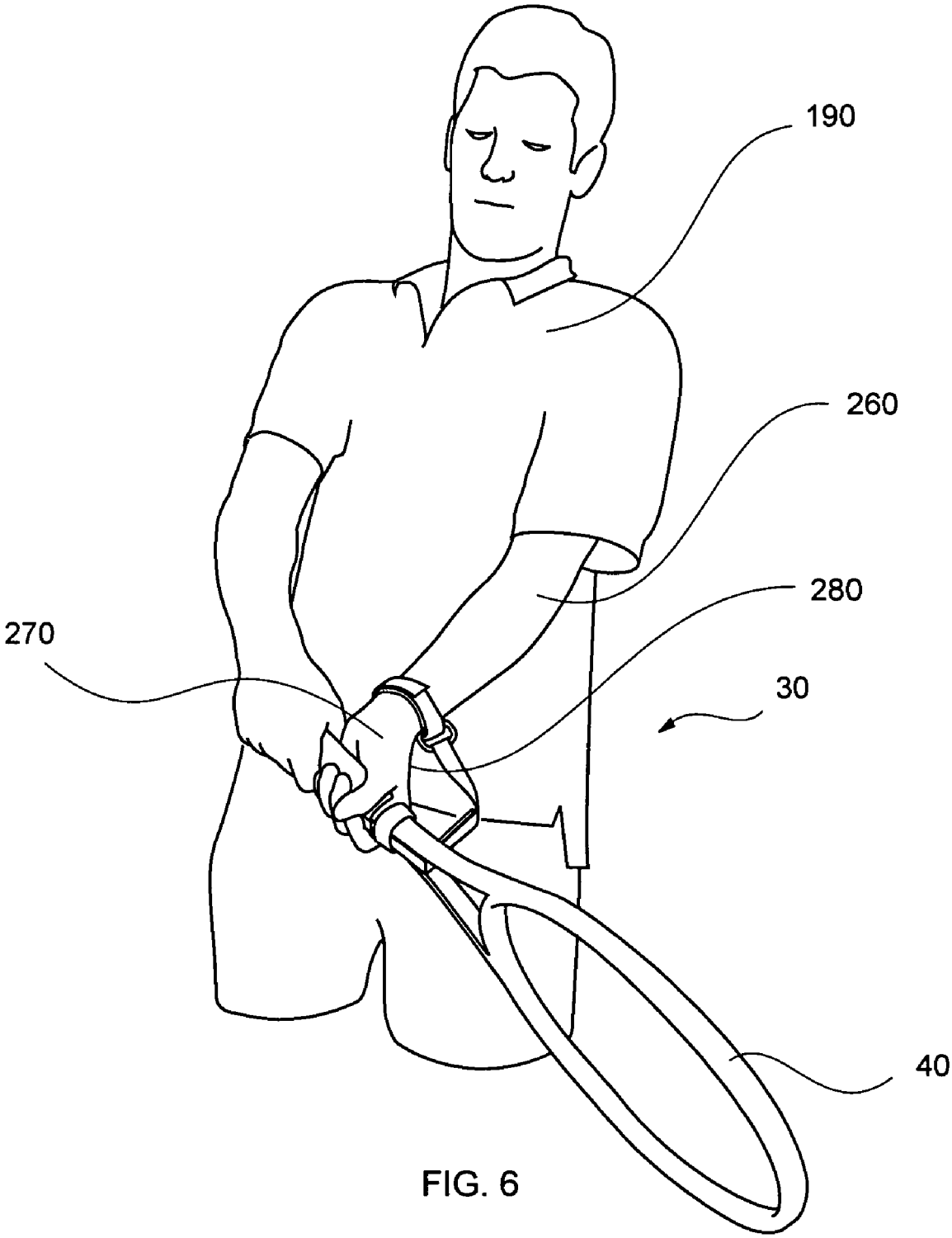

Referring now more specifically to FIG. 6, illustrated therein is an alternate embodiment of tennis training apparatus 10, wherein the alternate embodiment of FIG. 6 is substantially equivalent in form and function to that of the preferred embodiment detailed and illustrated in FIGS. 1-5, except as hereinafter specifically referenced. Specifically, the embodiment of FIG. 6 depicts tennis training apparatus 10 comprising only angle-restraining component 20, wherein tennis player 190 is shown in the course of a two-handed backhand stroke, wherein training apparatus 10 constrains and maintains the tennis player's hand 270 constrained backward in extension.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A training apparatus for a tennis player comprising:

a plate member, wherein said plate member is at least partially worn over the torso of the tennis player; and a wrist restraining member, wherein said wrist restraining member is secured to a tennis racket.

2. The training apparatus of claim 1, wherein said plate member constrains and maintains the player's shoulders and hips during movement of the player's arm describing a tennis stroke.

3. The training apparatus of claim 1, wherein said apparatus maintains the player's hand, hips and shoulders in an aligned configuration.

4. An apparatus for tennis training comprising:

an L-shaped attachment member removably secured to a tennis racket;

at least one connecting member; and at least one wristband, wherein said at least one connecting member is in communication with said attachment member and said at least one wristband, wherein said apparatus restrains and maintains a player's hand at an angle of approximately ninety degrees from the player's forearm.

5. The training apparatus of claim 4, wherein said L-shaped attachment member comprises a first leg and a second leg, and wherein said second leg extends through a gap in the tennis racket.

6. The training apparatus of claim 5, further comprising an inflexible restraining cord, wherein said inflexible restraining cord comprises a first end and a second end.

7. The training apparatus of claim 6, wherein said first end is secured to said second leg of said L-shaped attachment member.

8. The training apparatus of claim 7, wherein said second end of said restraining cord is secured to said at least one wristband.

9. The training apparatus of claim 4, wherein said L-shaped attachment member is secured to a neck portion of the tennis racket.

10. A method of training a tennis player, said method comprising the steps of:

a. obtaining a tennis training apparatus comprising an attachment member, at least one connecting member and at least one wristband, wherein said at least one connecting member is in communication with said attachment member and said at least one wristband, and wherein said apparatus restrains and maintains a player's hand at an angle of approximately ninety degrees from the player's forearm; and b. removably securing said tennis training apparatus to a tennis racket and to the tennis player.

11. The method of claim 10, further comprising the step of: performing a tennis stroke.

12. The method of claim 10, further comprising the step of: forming said attachment member into an L-shape.

13. The method of claim 10, further comprising the step of: removably securing a plate member to the tennis player.

14. The method of claim 13, further comprising the step of: utilizing said plate member to restrain the tennis player's hips and shoulders in alignment.

15. The method of claim 10, further comprising the step of: maintaining the player's hand, hips and shoulders in an aligned configuration.

* * * * *